United States Patent [19]

Uno et al.

[11] 4,447,524

[45] May 8, 1984

[54] PROCESS FOR PREPARING POLYOLEFIN RESIN-COATED PAPER FOR PHOTOGRAPHIC USE

[75] Inventors: Akira Uno, Matsudo; Touru Noda, Tokyo; Akira Ninohira, Funabashi, all of Japan

[73] Assignee: Mitsubishi Paper Mills, Ltd., Tokyo, Japan

[21] Appl. No.: 333,777

[22] Filed: Dec. 23, 1981

[30] Foreign Application Priority Data

Dec. 25, 1980 [JP] Japan ..... 55-184681

[51] Int. Cl.[3] ..... G03C 1/76; G03C 1/86; G03C 3/00

[52] U.S. Cl. ..... 430/538; 428/513; 430/536

[58] Field of Search ..... 427/391, 209, 211; 428/513; 430/536, 538

[56] References Cited

U.S. PATENT DOCUMENTS 3,501,298 3/1970 Crawford ..... 430/538 X 4,145,480 3/1979 Kusama et al. ..... 428/513

4,188,220 2/1980 Kasugai et al. ..... 430/538 X

FOREIGN PATENT DOCUMENTS 51-6531 1/1976 Japan .

*Primary Examiner*—Michael R. Lusignan

*Attorney, Agent, or Firm*—Cushman, Darby & Cushman

[57] ABSTRACT

In preparing a polyolefin resin coated paper for photographic use which comprises melt-extruding and coating a polyolefin resin composition containing titanium dioxide onto at least one surface of a paper sheet or a synthetic paper base, a polyolefin resin composition comprising polyolefin resin and titanium dioxide surface-treated with 0.2 to 1.2 wt % (calculated as $Al_2O_3$) of hydrous aluminum oxide based on titanium dioxide is employed as the polyolefin resin composition. By the use of such a polyolefin resin composition, problems on operation and quality due to generation of die lip stains could be solved without causing any quality problem such as photodeterioration, or the like.

8 Claims, No Drawings

PROCESS FOR PREPARING POLYOLEFIN RESIN-COATED PAPER FOR PHOTOGRAPHIC USE

BACKGROUND OF THE INVENTION

Field of the Invention

The present invention relates to a process for producing a polyolefin resin-coated paper which is used as a photographic support and more particularly to prevention of deterioration in surface quality due to contamination of a die lip which is caused upon preparation of a photographic support by melt-extruding a polyolefin resin composition containing titanium dioxide into a film state and coating such onto at least one surface of a paper sheet or a synthetic paper base.

A polyolefin resin-coated paper for photographic use is already known and a photographic polyolefin resin-coated paper as disclosed in, e.g., U.S. Pat. No. 3,501,298 comprises coating both surfaces of a paper base with polyethylene resin which contains titanium dioxide, blue pigments, fluorescent whitening agents, etc. in a polyethylene layer on the emulsion-coated side.

However, there is a tendency that needle-like or icicle-like attaches or stains (hereafter simply referred to as "die lip stains") generate at the top of a die lip by extrusion in a short period of time upon melt-extrusion of a polyolefin resin composition containing titanium dioxide, particularly a polyethylene resin composition containing titanium dioxide from a slit die in a film shape and, to be difficult to deal with, there is a tendency that these dye lip stains grow more and more with the passage of time for melt extrusion.

If the dye lip stains generate upon coating by melt-extrusion, streaks are formed on the surface of a photographic support in the longitudinal direction thereof, when the support is prepared in that state, or streakened uneveness in coating is formed due to an uneven coated amount, or stains are sometimes attached and coated onto a film to thereby produce foreign matters. For these reasons, surface quality of a polyolefin resin-coated paper thus prepared is seriously damaged and quite inadequate and of no commercial value for use of a photographic support which requires excellent surface quality.

Further, for completely removing die lip stains once formed, there is nothing but discontinuing the production line and cleaning a die lip; hard labors and time are required for the cleaning and such results in serious reduction in producibility. Thus immediate solution of such a problem has been desired.

An object of the present invention is to provide a process for producing a polyolefin resin-coated paper for photographic use capable of preventing deterioration in surface quality due to die lip stains which generate upon preparing a polyolefin resin-coated paper for photographic use.

As a result of extensive investigations on causes for generating the die lip stains, the present inventors have found that the die lip stains are seriously affected by titanium dioxide contained in the polyolefin resin composition. That is, noting the content of $TiO_2$, if the content of $TiO_2$ in the polyolefin resin composition is decreased, die lip stains generated are reduced but a shielding power becomes poor so that the product cannot be used as a photographic support. On the other hand, if the content of $TiO_2$ is increased, a shielding power is sufficient but it has been found that die lip stains seriously occur.

It has further been found that die lip stains are affected not only by the addition amount of titanium dioxide but also by titanium dioxide per se employed.

In the case where no titanium dioxide is incorporated into a resin layer of a photographic support, of course, sharpness is seriously deteriorated and the support is useless as a photographic support.

Titanium dioxide conventionally used in the photographic art is titanium dioxide which is modified by depositing hydrous aluminum oxide or hydrous aluminum oxide and hydrous silicon dioxide onto the particle surface of titanium dioxide as disclosed, for example, in Japanese Patent Application KOKAI No. 35625/77 (The term "KOKAI" refers to an unexamined application open to public inspection.), etc.

Reasons way titanium dioxide to which surface treatment has been made to such a high extent is employed in the photographic art are because, as are also described in Japanese Patent Application KOKAI No. 35625/77, in the case of using titanium dioxide which has undergone no surface treatment or surface treatment to a very mild extent (an amount of a surface treating agent is less than 0.2 wt % based on titanium dioxide):

(1) This titanium dioxide adversely affects photographic emulsion.
(2) Dispersibility of titanium dioxide becomes poor.
(3) Adhesion between a resin layer and an emulsion layer becomes poor.
(4) White background of a photograph is liable to undergo change with the passage of time.
(5) Whitening effect with a fluorescent whitening agent is poor.

Hardly is thus such titanium dioxide used in a resin layer of a photographic support requiring particularly severe quality that has undergone no surface treatment or surface treatment to a very mild extent. However, as titanium dioxide is subjected to surface treatment to such a high extent for satisfying the requirement in the art, occurrence of die lip stains becomes serious.

As a result of extensive investigations on simultaneous solution of these contradictory problems, i.e., problem in quality such as liability of undergoing color change at the white background with the passage of time (hereafter referred to as "photodeterioration") and problem on operation due to serious occurrence of die lip stains (which leads to poor quality as a result), the present inventors have reached the present invention.

SUMMARY OF THE INVENTION

The present invention is directed to a process for preparing a polyolefin resin-coated paper for photographic use comprising melt-extruding and coating a polyolefin resin composition containing titanium dioxide onto at least one surface of a paper sheet or a synthetic paper base characterized in that said polyolefin resin composition comprises a polyolefin resin and titanium dioxide which is surface treated with 0.2 to 1.2 wt % (calculated as $Al_2O_3$) of hydrous aluminum oxide based on titanium dioxide.

In the case where a polyolefin resin composition comprising a polyolefin resin having formulated therein titanium dioxide—which is surface treated with 0.2 to 1.2 wt % (calculated as $Al_2O_3$) based on titanium dioxide—is coated through a melt extruder, generation of die lip stains is markedly prevented and a polyolefin resin-coated paper for photographic use can be prepared without discontinuing production.

Further in the case of using the thus prepared polyolefin resin-coated paper for photographic use as a photographic support, high quality product which is quite comparable with photographic supports conventionally used—to which surface treatment is applied to a high extent and in which titanium dioxide is incorporated—with respect to photodeterioration is obtained.

While it is not entirely clear as to why die lip stains which result in deterioration in surface quality of a photographic support are caused, it is believed that die lip stains would generate due to unstable flow of a polyolefin resin composition. This unstable flow is remarkably noted particularly and liable to be converted into a melt of high viscosity when a high density polyethylene resin is incorporated into the polyolefin resin composition. In general, a photographic support encounteres to form curling due to marked difference in structure between the surface and the back surface thereof since photographic emulsion layers are provided on a resin layer containing titanium dioxide. It has been a conventional means in the photographic art that curling is balanced by incorporating a high density polyethylene resin in the resin layer containing titanium dioxide as well as in the back surface resin layer to thereby compensate for the difference and, even noting that the high density polyethylene resin accelerates the unstable flow, the high density polyethylene resin should have been incorporated into a polyolefin resin composition in view of requirement for quality. Accordingly, it has been immediate necessity to find a polyolefin resin composition showing stable flow even when such a high density polyethylene resin is incorporated therein, in preparing a photographic support. In order to cause no unstable flow of a polyolefin melt, such can be achieved by considerably decreasing a melt viscosity of a polyolefin resin composition which forms a resin layer of a photographic support; however, in this case, neck-in becomes extremely large upon extrusion and coating and such results in serious problem on operation.

The titanium oxide which can be employed in the present invention is titanium dioxide which is surface treated with 0.2 to 1.2 wt % (calculated as $Al_2O_3$) of hydrous aluminum oxide based on titanium oxide (hereinafter referred to as "$TiO_2$ termed in the present invention"). The polyolefin resin composition obtained by formulating this $TiO_2$ in polyolefin resin causes no die lip stains even when the polyolefin indicates a high melt viscosity; also in the system in which polyethylene having particularly high density is formulated, the composition is not adversely affected thereby and exhibits excellent effect for preventing occurrence of die lip stains.

The amount of hydrous aluminum oxide used for surface treatment of $TiO_2$ is generally in a range of from 0.2 to 1.2 wt % (calculated as $Al_2O_3$), preferably from 0.5 to 1.0 wt %. When the amount is smaller than 0.2 wt %, it is sufficient for prevention of die lip stains but photodeterioration is serious and such a system is of no practical use. Further if the amount exceeds 1.2 wt %, photodeterioration is improved but die lip stains generate; such becomes problem on operation as well as product quality.

A method for surface treatment for obtaining the $TiO_2$ termed in the present invention is performed in accordance with a method as described in, for example, Japanese Patent Application KOKOKU No. 17620/72 (the term "KOKOKU" is meant to refer to an examined application published for purpose of opposition).

As the $TiO_2$ termed in the present invention, any of rutile type and anatase type can be used as long as they are surface-treated $TiO_2$ using 0.2 to 1.2 wt % (calculated as $Al_2O_3$) of hydrous aluminum oxide based on titanium dioxide. Further the particle size of the $TiO_2$ is not particularly limited and titanium dioxide commercially available which has a particle size of about 0.1 to about 1$\mu$ is also usable; however, in view of a shielding power, etc., it is preferred to use titanium dioxide having a particle size of from about 0.15 to about 0.35$\mu$.

The most preferred $TiO_2$ in the present invention is that obtained by subjecting wet-classified and no surface-treated $TiO_2$ to surface treatment using 0.5 to 1.0 wt % (calculated as $Al_2O_3$) of hydrous aluminum oxide based on $TiO_2$.

If the content of $TiO_2$ in a polyolefin resin is smaller than 5 wt %, a shielding power is insufficient as a photographic support and, on the other hand, if the content is greater than 40 wt %, fluidizability, etc. are reduced and such is not preferable. It is thus particularly preferred that the content be in a range of from 9 wt % to 25 wt %.

As polyolefins in the present invention, a low density polyethylene, a high density polyethylene and polypropylene having various densities and melt indices can be employed singly or as a mixture thereof.

In the present invention, it is not required to formulate any agent for preventing photodeterioration, assistant for preventing die lip stains, etc. since the $TiO_2$ termed in the present invention has excellent effects; however, if necessary, metals salts of aliphatic acids or the like can be incorporated into the composition. Specific examples of metals salts of aliphatic acids which can be employed in accordance with the present invention include zinc stearate, calcium stearate, aluminum stearate, magnesium stearate, zirconium octylate, sodium palmitate, calcium palmitate, sodium laurate, etc. The addition amount of the metal salts of aliphatic acids ranges from 0.01 to 5 wt % based on the polyolefin resin composition containing $TiO_2$, generally from 0.02 to 2 wt %.

The polyolefin resin composition in the present invention may also contain, in addition to $TiO_2$, white pigments such as zinc oxide, talc, calcium carbonate, etc.; aliphatic acid amides such as stearic acid amide, arachiodic acid amide, etc.; antioxidants such as tetrakis[methylene-3-(3,5-di-tert-butyl-4-hydroxyphenyl)-propionate]methane, 2,6-di-tert-butyl-4-methylphenol, etc.; color pigments such as ultramarine, Indian red, etc.; fluorescent whitening agents and the like.

The polyolefin resin-coated paper of the present invention can be prepared by melt-extruding and coating a polyolefin resin composition onto a running paper sheet or synthetic paper base (hereafter merely referred to as "base paper") through a slit die into a film shape. In this case, it is preferred that a temperature for melt extrusion be in a range of from 200° C. to 350° C. As slit dies, flat dies such as a T-shaped die, an L-shaped die, a fish tail type die, etc. are preferably used and a diameter of the slit opening is desirably of from 0.1 to 1 mm. It is also preferred that, prior to coating the resin composition onto base paper, the base paper be subjected to activation treatment such as a corona discharge treatment, a flame treatment, etc. A thickness of the resin layer of the resin-coated paper is not overly limited but the resin layer obtained by extrusion-coating in a thickness of from about 5 to about 50 microns is generally advantageous. Further in ordinary polyolefin-resin coated paper, both surfaces of which base paper are coated with resin, the resin surface (emulsion-coated surface) containing $TiO_2$ possesses a glossy surface, a mat surface, a silky surface, etc. depending upon utility and the back surface is generally a non-glossy surface; the surface thereof or, if necessary, both the surface and the back surface can be subjected to activation treatment such as a corona discharge treatment, a flame treatment, etc.

Base paper which can be employed for the practice of the present invention can be any of ordinary paper made of natural pulp, paper made of synthetic fibers and so-called synthetic paper obtained by paper-making of synthetic resin films, but paper made of natural pulp mainly composed of wood pulp such as needle leaf pulp, broadleaf pulp or a pulp mixture of needle leaf pulp and broadleaf pulp is advantageously employed. A thickness of base paper is not particularly limited but it is preferred to use base paper having smooth surface. Basis weight of base paper is preferably of from 50 $g/m^2$ to 250 $g/m^2$.

Base paper mainly composed of natural pulp which is advantageously employed for the practice of the present invention may contain various high molecular weight substances and additives. For example, cationized starch, cationized polyacrylamide, anionized polyacrylamide, carboxy-modified polyvinyl alcohol, gelatin, etc. can be incorporated as paper intensifiers for dry paper; aliphatic acid salts rosin derivatives, dialkylketene dimer emulsions, petroleum resin emulsions, ammonium salts of styrenemaleic anyhydride copolymer alkyl esters, etc. as sizing agents; clay, kaolin, calcium carbonate, barium sulfate, titanium dioxide, etc. as pigments; melamine resins, urea resins, epoxylated polyamide resins, etc. as paper intensifiers for wet paper; polyvalent metal salts such as aluminum sulfate, aluminum chloride, etc., cationic polymers such as cationized starch, etc. as fixing agents; sodium hydroxide, sodium carbonate, hydrochloric acid, etc. as pH controlling agents; salt, a Glauber's salt, etc. as inorganic electrolytes; in addition, dyes, fluorescent whitening agents, latexes, and the like can also be incorporated in appropriate combination.

Various silver halide photographic emulsion layers such as emulsion layers of silver chloride, silver bromide, silver chlorobromide, silver iodobromide and silver chloroiodobromide can be provided onto the polyolefin resin-coated paper in accordance with the present invention which is used as a photographic support. Further, color couplers can also be incorporated into the silver halide photographic emulsion layers to form a multi-layered silver halide photographic element. As binders for these silver halide emulsion layers, in addition to ordinary gelatin, hydrophilic high molecular weight substances such as polyvinyl pyrrolidine, polyvinyl alcohol, sulfuric acid esters of polysaccharides, etc. can be employed. Further, the aforesaid silver halide emulsion layers can also contain various additives. For example, cyanine dyes, merocyanine dyes, etc. can be incorporated as sensitizing dyes; water soluble gold compounds, surfur compounds, etc. as chemical sensitizers; hydroxy-triazolopyrimidine compounds, mercapto-heterocyclic compounds, etc. as antifoggants or stabilizers; formalin, vinylsulfone compounds, aziridine compounds, etc. as hardening agents; benzene sulfonates, sulfosuccinic acid ester salts, etc. as coating aids; dialkylhydroquinone compounds as stain-preventing agents; benzotriazole compounds as UV absorbants; fluorescent whitening agents; dyes for improving sharpness; antistatic agents, pH controlling agents; further, water soluble iridium, rhodium compounds upon formation and dispersion of silver halide, etc.; these additives can be incorporated in appropriate combination.

The present invention will be further explained in more detail with reference to the examples below.

EXAMPLE 1

Seventy (70) parts by weight of low density polyethylene [MI (melt index)=4, density 0.923] and 30 parts by weight of $TiO_2$ (the kind of $TiO_2$ and the amount of hydrous aluminum oxide used for surface treatment are shown in Table 1) were thoroughly kneaded at 150° C. using a Banbury mixer to obtain a master batch containing $TiO_2$.

The thus obtained $TiO_2$-containing master batch (30 parts by weight) and as diluting resins, 40 parts by weight of low density polyethylene (MI=5, density 0.918) and 30 parts by weight of high density polyethylene (MI=5, density 0.968) were mixed in a dry state. The resulting mixture was melt-extruded and coated onto a photographic base paper having basis weight of 160 $g/m^2$ at a melt temperature of 320° C. and a coating rate of 100 m/min. in a coated amount of 30 $g/m^2$. A melt extruder used had a screw type extruder having an extrusion opening of 65 mm and a T-shaped die having a width of 750 mm. Further, a cast cooling roll having a flat smooth surface subjected to hard chromium plating was employed.

The term "number of die lip stains" shown in Table 1 is meant to refer to the number of die lip stains after 2 hrs. from the initiation of melt extrusion.

Further the term "Y concentration" refers to a Y concentration obtained by measuring the surface of a sample after irradiation with a fadeometer FAL-25X-HCL Model (manufactured by the Suga Shikenki Co., Ltd.) for 120 hrs. using a Macbeth densitometer (TD-504 Model).

TABLE 1

| Run No. | Kind of $TiO_2$ | Amount of Surface Treatment (wt % based on $TiO_2$) | Number of Die Lip Stains: Front Side | Rear Side | Total | Y Concentration |
|---|---|---|---|---|---|---|
| 1 | No surface treatment Anatase type $TiO_2$ | 0 | 0 | 0 | 0 | 0.14 |
| 2 | Anatase type $TiO_2$ surface-treated with alumina | 0.15 | 0 | 0 | 0 | 0.10 |
| 3 | Anatase type | 0.25 | 0 | 0 | 0 | 0.07 |

TABLE 1-continued

| Run No. | Kind of $TiO_2$ | Amount of Surface Treatment (wt % based on $TiO_2$) | Number of Die Lip Stains Front Side | Rear Side | Total | Y Concentration |
|---|---|---|---|---|---|---|
| | $TiO_2$ surface-treated with alumina | | | | | |
| 4 | Anatase type $TiO_2$ surface-treated with alumina | 0.5 | 0 | 0 | 0 | 0.05 |
| 5 | Anatase type $TiO_2$ surface-treated with alumina | 1.0 | 0 | 0 | 0 | 0.05 |
| 6 | Anatase type $TiO_2$ surface-treated with alumina | 1.25 | 2 | 3 | 5 | 0.05 |
| 7 | Anatase type $TiO_2$ surface-treated with alumina | 2.0 | >50 | >50 | >50 | 0.05 |

From the results shown in Table 1, it is understood that the smaller the amount of alumina (hydrous aluminum oxide) used for surface treatment to $TiO_2$, the more effective for prevention of die lip stains; the die lip satins are considerably improved with the amount of 1.25 wt % and with the amount of smaller than 1.0 wt %, no die lip stain occurs.

To the contrary, it is seen that photodeterioration is more improved as the amount of alumina used for surface treatment to $TiO_2$ becomes large, and photodeterioration is effectively prevented if the amount is greater than 0.25 wt %.

EXAMPLE 2

A mixture of 70 parts by weight of low density polyethylene (MI=9, density 0.918), 30 parts of $TiO_2$ (the kind of $TiO_2$ and the amount of hydrous aluminum oxide used for surface treatment are shown in Table 2) and 1.5 part by weight of zinc stearate was thoroughly kneaded at 150° C. using a Banbury mixer to obtain a master batch containing $TiO_2$.

40 parts by weight of the thus obtained $TiO_2$-containing master batch and as diluting resins, 30 parts of low density polyethylene (MI=5, density 0.918) and 30 parts of high density polyethylene (MI=5, density 0.962) were mixed in a dry state.

Thereafter, the same procedure was repeated as in Example 1 to obtain a polyethylene resin-coated paper for photographic use. Using the thus obtained polyethylene resin-coated paper, evaluation was performed as in Example 1.

Results obtained are shown in Table 2 below.

TABLE 2

| Run No. | Kind of $TiO_2$ | Amount of Surface Treatment (wt % based on $TiO_2$) | Number of Die Lip Stains Front Side | Rear Side | Total | Y Concentration |
|---|---|---|---|---|---|---|
| 8 | No surface treatment Anatase type $TiO_2$ | 0 | 0 | 0 | 0 | 0.10 |
| 9 | Anatase type $TiO_2$ surface-treated with alumina | 0.15 | 0 | 0 | 0 | 0.08 |
| 10 | Anatase type $TiO_2$ surface-treated with alumina | 0.25 | 0 | 0 | 0 | 0.05 |
| 11 | Anatase type $TiO_2$ surface-treated with alumina | 0.5 | 0 | 0 | 0 | 0.05 |
| 12 | Anatase type $TiO_2$ surface-treated with alumina | 1.0 | 0 | 0 | 0 | 0.04 |
| 13 | Anatase type $TiO_2$ surface-treated with alumina | 1.25 | 4 | 3 | 7 | 0.04 |
| 14 | Anatase type $TiO_2$ surface-treated with alumina | 2.0 | >50 | >50 | >50 | 0.04 |

From the results shown in Table 2, it is seen that in the case of using a polyethylene resin composition having formulated therein the $TiO_2$ termed in the present invention, no die lip stain is caused, even when the $TiO_2$ content is increased, with the 1.0% amount of alumina used for surface treatment, and even with the amount of 1.25%, die lip stains are considerably prevented; further, photodeterioration is also effectively improved with the amount of greater than 0.25%. The thus prepared photographic support is useful as a high quality photographic support requiring excellent resolving power due to a high content of $TiO_2$.

EXAMPLE 3

A mixture of 70 parts by weight of low density polyethylene (MI=4, density 0.923), 30 parts by weight of $TiO_2$ (the kind of $TiO_2$ and the amount of hydrous aluminum oxide used for surface-treatment are shown in Table 3) and 1.5 part by weight of zinc stearate was thoroughly kneaded at 150° C. using a Banbury mixer to obtain a master batch containing $TiO_2$.

A composition (resin formulation A) of 30 parts by weight of the thus obtained $TiO_2$-containing master batch and as a diluting resin, 70 parts by weight of low density polyethylene (MI=5, density 0.918) and a composition (resin formulatin B) of 40 parts by weight of the aforesaid master batch and 60 parts by weight of the aforesaid low density polyethylene were mixed in a dry state, respectively. Thereafter, the same procedure was repeated as in Example 2 and the same evaluatin was performed.

Results obtained are shown in Table 3 below.

TABLE 3

| Run No. | Formulation | Kind of $TiO_2$ | Amount of Surface treatment (wt % based on $TiO_2$) | Number of Die Lip Stains Front Side | Rear Side | Total | Y Concentration |
|---|---|---|---|---|---|---|---|
| 15 | A | No surface treatment anatase type $TiO_2$ | 0 | 0 | 0 | 0 | 0.12 |
| 16 | | Anatase type $TiO_2$ surface-treated with alumina | 0.15 | 0 | 0 | 0 | 0.09 |
| 17 | | Anatase type $TiO_2$ surface-treated with alumina | 0.25 | 0 | 0 | 0 | 0.06 |
| 18 | | Anatase type $TiO_2$ surface-treated with alumina | 0.5 | 0 | 0 | 0 | 0.04 |
| 19 | | Anatase type $TiO_2$ surface-treated with alumina | 1.0 | 0 | 0 | 0 | 0.04 |
| 20 | | Anatase type $TiO_2$ surface-treated with alumina | 1.25 | 0 | 0 | 0 | 0.04 |
| 21 | | Anatase type $TiO_2$ surface-treated with alumina | 2.0 | 4 | 4 | 8 | 0.04 |
| 22 | B | No surface treatment anatase type $TiO_2$ | 0 | 0 | 0 | 0 | 0.10 |
| 23 | | Anatase type $TiO_2$ surface-treated with alumina | 0.15 | 0 | 0 | 0 | 0.08 |
| 24 | | Anatase type $TiO_2$ surface-treated with alumina | 0.25 | 0 | 0 | 0 | 0.05 |
| 25 | | Anatase type $TiO_2$ surface-treated with alumina | 0.5 | 0 | 0 | 0 | 0.04 |
| 26 | | Anatase type $TiO_2$ surface-treated with alumina | 1.0 | 0 | 0 | 0 | 0.04 |
| 27 | | Anatase type $TiO_2$ surface-treated with alumina | 1.25 | 0 | 0 | 0 | 0.04 |
| 28 | | Anatase type $TiO_2$ surface-treated with alumina | 2.0 | 12 | 15 | 27 | 0.04 |

From the results shown in Table 3, it can be seen that in the case of using low density polyethylene alone in a resin-formulated composition, die lip stains are considerably improved but in the case of resin formulation B in which the $TiO_2$ content in the polyethylene resin composition is large, considerable generation of die lip stains was observed with the 2.0% amount of alumina used for the surface treatment of $TiO_2$. However, within the range of the amount of hydrous aluminum oxide used for the surface treatment called for in the present invention, both resin compositions A and B provided good results with respect to die lip stains and photodeterioration.

EXAMPLE 4

Using a Banbury mixer 70 parts by weight of low density polyethylene (MI=9, density 0.918), 30 parts by weight of titanium dioxide and 1.5 part by weight of zinc stearate were thoroughly kneaded at 150° C. to obtain a master batch containing titanium dioxide.

In 30 parts by weight of the thus obtained master batch containing titanium dioxide, there were added as diluting resins, the same low density polyethylene as used for the master batch and high density polyethylene (MI=7, density 0.962) as described in Table 4 to have the total weight of 100 parts by weight and the resulting compositions were mixed in a dry state, respectively.

Thereafter, the same procedure was repeated as in Example 1 to obtain photographic supports. The thus obtained photographic supports were evaluated in a manner similar to Example 1.

Results obtained are shown in Table 4 below.

TABLE 4

| Run No. | Amount of Surface Treatment (Weight % based on $TiO_2$) | Amounts of High Density Polyethylene in Polyethylene resin Layer at the emulsion-coated side (parts by weight) | Number of Die Lip Stains Front Side | Rear Side | Total | Adhesion(1) |
|---|---|---|---|---|---|---|
| 29 | 0.75 | 0 | 0 | 0 | 0 | O |
| 30 | " | 5 | 0 | 0 | 0 | O |
| 31 | " | 30 | 0 | 0 | 0 | O |
| 32 | " | 60 | 0 | 1 | 1 | Δ |
| 33 | " | 70 | 1 | 1 | 2 | X |
| 34 | 2.0 | 0 | 4 | 4 | 8 | O |
| 35 | " | 5 | 8 | 6 | 14 | O |
| 36 | " | 30 | >50 | >50 | >100 | O |
| 37 | " | 60* | >50 | >50 | >100 | Δ |
| 38 | " | 70* | >50 | >50 | >100 | X |

*When 60 and 70 parts by weight of high density polyethylene was formulated, die lip stains of 100 or more in total were caused after 30 and 20 minutes from the initiation of melt extrusion.

Note:

(1)Adhesion was measured as followed.

In a manner similar to Example 1, a polyethylene resin-coated paper comprising a base paper having provided thereon a polyethylene resin layer was prepared. This coated paper was scratched with a knife in 5×25 cm (long in the width direction). After the resin layer along was slightly picked up with a pincette from the paper surface, the resin layer alone was stripped out from the base paper with the finger. Then, adhesion was judged by degree of fibers adhered to the back surface of the resin layer.

When the amount of fibers adhered to the surface of the resin layer takes an area exceeding 80% of the area of the resin layer, evaluation is o; Δ when the area is between 40 and 80% and x when the area is smaller than 40%. When the evaluatin is o or Δ, adhesion is sufficient for practical use.

What is claimed is:

1. In a process for preparing a polyethylene resin-coated paper for photographic use which comprises melt-extruding and coating film shape of a polyethylene resin composition containing titanium dioxide onto at least one surface of a paper sheet or a synthetic paper base, the improvement comprising using polyethylene resin in the polyethylene resin layer on the photographic emulsion layer side containing 5 to 60 wt % of high density polyethylene and said polyethylene resin composition comprising polyethylene resin and titanium dioxide surface-treated with 0.2 to 1.2 wt % (calculated as $Al_2O_3$) of hydrous aluminum oxide based on titanium dioxide as said polyethylene resin composition.

2. The process as claimed in claim 1 wherein the amount of hydrous aluminum oxide used for surface treatment of the titanium dioxide is 0.5–1.0 wt %.

3. The process as claimed in claim 1 wherein the amount of high density polyethylene in the polyethylene resin layer on the photographic emulsion layer side ranges from 5 to 30 wt %.

4. The process as claimed in claim 1 wherein the amount of titanium dioxide in the polyethylene resin layer on the photographic emulsion layer side ranges from 5 to 40 wt %.

5. The process as claimed in claim 4 wherein the amount of titanium dioxide ranges from 9 to 25 wt %.

6. The process as claimed in claim 1 wherein the particle size of titanium oxide ranges from 0.15 to 0.35μ.

7. The process as claimed in claim 1 wherein titanium dioxide which is wet-classified and undergoes no surface treatment is employed as titanium dioxide to be surface-treated with said hydrous aluminum oxide.

8. A polyolefin resin-coated paper for photographic use obtained by the process as claimed in claim 1.

* * * * *